US006291802B1

(12) United States Patent
Ford

(10) Patent No.: US 6,291,802 B1
(45) Date of Patent: Sep. 18, 2001

(54) SAMPLE INTRODUCTION ASSEMBLY

(75) Inventor: Gordon C. Ford, St. Joseph, MI (US)

(73) Assignee: Leco Corporation, St. Joseph, MI (US)

( * ) Notice: Subject to any disclaimer, the term of this patent is extended or adjusted under 35 U.S.C. 154(b) by 0 days.

(21) Appl. No.: 09/705,402

(22) Filed: Nov. 3, 2000

(51) Int. Cl.[7] ..... F27B 9/38; F27B 14/16

(52) U.S. Cl. ..... 219/427; 219/392; 373/118; 414/200

(58) Field of Search ..... 219/392, 420, 219/421, 427; 373/115, 118; 414/199, 200

(56) References Cited

U.S. PATENT DOCUMENTS

| | | | |
|---|---|---|---|
| 3,899,627 | 8/1975 | Sitek et al. . | |
| 3,936,587 | 2/1976 | Sitek et al. . | |
| 4,056,677 | 11/1977 | Berk et al. . | |
| 4,371,971 | 2/1983 | Bredeweg . | |
| 4,510,610 * | 4/1985 | Hosokawa et al. | 373/118 |
| 5,314,662 | 5/1994 | Hemzy et al. . | |
| 5,395,586 | 3/1995 | Hemzy et al. . | |

* cited by examiner

*Primary Examiner*—Joseph Pelham
(74) *Attorney, Agent, or Firm*—Price, Heneveld, Cooper DeWitt & Litton

(57) ABSTRACT

A sample introduction system includes a drop chamber which can be sealed and outgassed and which includes a movable jaw selectively holding the sample in position above a conduit communicating with an open crucible for receiving a sample once the jaw has been moved to an open position releasing the sample. The jaw is actuated by a magnetic field which moves the jaw in an entirely enclosed system, thereby preventing the introduction of atmospheric contaminants during the operation of the sample dropping jaw from a closed, sample holding position to an open sample releasing position. By providing a magnetic actuator, such as a solenoid, for operation of the jaw, the sample chamber remains sealed during the sample dropping operation preventing contaminants from interfering with the analytical results.

36 Claims, 3 Drawing Sheets

SAMPLE INTRODUCTION ASSEMBLY

BACKGROUND OF THE INVENTION

The present invention relates to a sample introduction assembly for loading small samples into analytical crucibles for subsequent analysis and particularly to a seal system which prevents the admission of contaminants.

In analytical furnaces for combusting relatively small (1 mg to 0.5 gram) samples of, for example, steel pins, chips, or the like, typically resistance or induction furnaces are employed. Graphite crucibles are employed for resistance heating of a crucible directly when placed between a pair of electrodes. Ceramic crucibles are employed in furnaces in which heating is by an induction field provided by an RF coil. In either furnace, it is necessary initially to outgas the crucible and assure no contaminant gases are mixed with the specimen gases during loading of the sample.

In several prior art systems, it is necessary to open the combustion chamber area after the outgassing to gain access to a crucible for insertion of a sample to be analyzed. In doing so, the crucible is exposed to atmospheric gases which can contaminate the crucible to an extent that the analytical results can be adversely effected. In order to prevent the introduction of contaminants, one solution has been to provide a sample loading mechanism which allows the introduction of a sample into a movable hopper which is subsequently sealed and the area purged with an inert gas. The jaws of the hopper are subsequently opened to allow admission of the sample into the crucible through an electrode assembly. U.S. Pat. No. 4,371,971 discloses such an apparatus which, although preventing a direct communication path with the atmosphere during admission of the sample, may allow a small amount of atmospheric gases to enter the combustion chamber during the sample loading operation through the dynamic seals on the movable jaw actuator. With analyzers designed to measure oxygen and nitrogen content of a specimen, even miniscule amounts of atmospheric oxygen and nitrogen adds inaccuracy to analytical results, particularly for low concentration samples. Even with sealed sample dropped mechanisms where linear acting pistons move through radial seals, gases trapped in imperfections on the shaft surface are introduced to the analytical specimen, degrading the precision and accuracy of the measured amount of oxygen and nitrogen. Also, with time, atmospheric leakage increases as dynamic seals wear due to high cyclical use.

Accordingly, there exists a need for an improved sample introduction system in which contamination from atmospheric contaminants can be eliminated.

SUMMARY OF THE INVENTION

The system of the present invention solves this need by providing a sample introduction system in which a sample is introduced into a drop chamber which can be sealed and purged and which includes a movable jaw selectively holding the sample in position above a conduit communicating with an open crucible for receiving a sample once the jaw has been moved to an open position releasing the sample. The jaw is actuated by a magnetic field which moves the jaw in an enclosed environment, thereby preventing the introduction of atmospheric contaminants during the operation of the sample dropping jaw from a closed, sample holding position to an open sample releasing position. By providing a magnetic actuator, such as a solenoid, for operation of the jaw, the sample chamber remains sealed during the sample dropping operation preventing contaminants from interfering with the analytical results.

These and other features, objects and advantages of the present invention will become apparent upon reading the following description thereof together with reference to the accompanying drawings.

DETAILED DESCRIPTION OF THE PREFERRED EMBODIMENT

Figure 1:
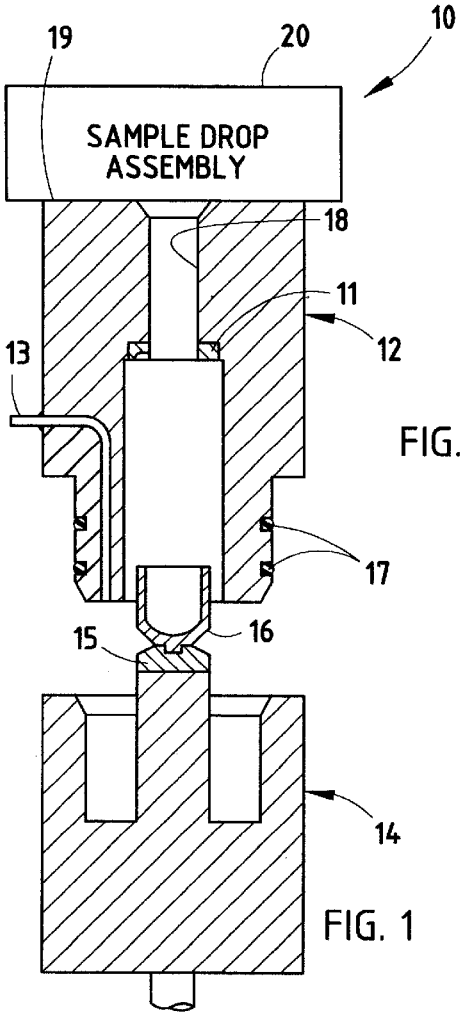
FIG. 1 is a vertical cross-sectional schematic view of an analytical furnace showing the environment of the present invention.
Figure 7:
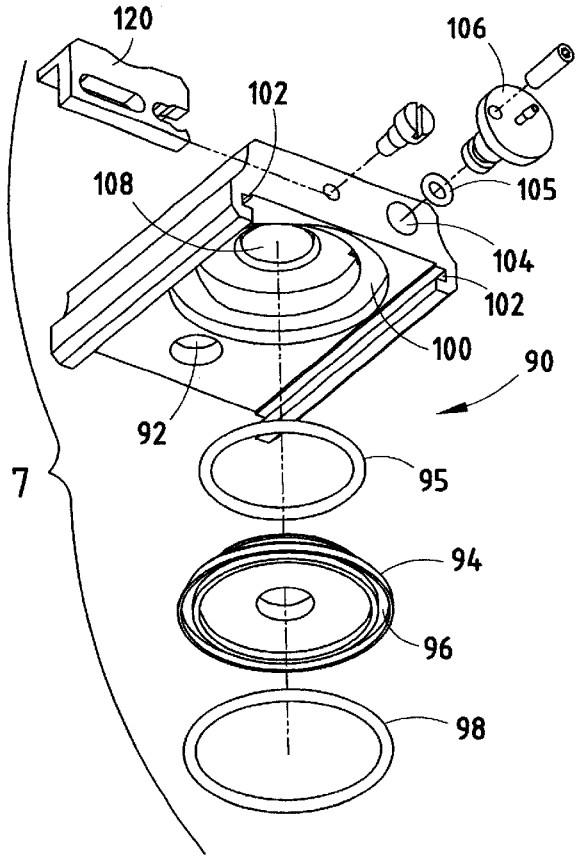
FIG. 7 is an exploded perspective view of the sample drop slide and seal assembly shown also in FIG. 2.

In FIG. 1, there is shown an analytical resistance furnace 10, which includes an upper electrode assembly 12 and a lower electrode assembly 14 for supporting a graphite crucible 16 having a pedestal base sitting upon the electrode post 15 of the lower electrode assembly 14. The upper electrode assembly includes a conduit 18 for admission of a sample from the sample drop assembly shown in FIG. 3, which rests on and is attached to the upper surface 19 of the upper electrode assembly 12 in a conventional manner by fasteners or the like. The electrode assemblies 12 and 14 can be of the type disclosed in U.S. Pat. No. 4,056,677 or the type employed in commercially available instruments such as the TC500 manufactured by Leco Corporation of St. Joseph, Mich. During combustion of a sample, electrode assemblies 12 and 14 come together with O-ring seals 17 enclosing the combustion area and byproducts of combustion exit through a discharge tube 13 into an analyzer for analysis of byproducts of combustion. A carrier gas, such as helium, is introduced through conduit 18, as described in greater detail below, through the sample drop jaw assembly. The upper edge of crucible 16 engages the annular electrode 11 of the upper electrode assembly 12 and an electrical current is passed through the graphite crucible 16 to heat and combust samples positioned therein through the unique sample jaw drop assembly of the present invention. Crucible 16 may, for example, be of the type disclosed in U.S. Pat. No. 3,899,627. Although this invention is described in the environment of a resistance heating furnace 10, the invention can be used in induction and other types of furnaces where it is necessary to admit a sample into an analytical crucible for combustion.

Figure 3:
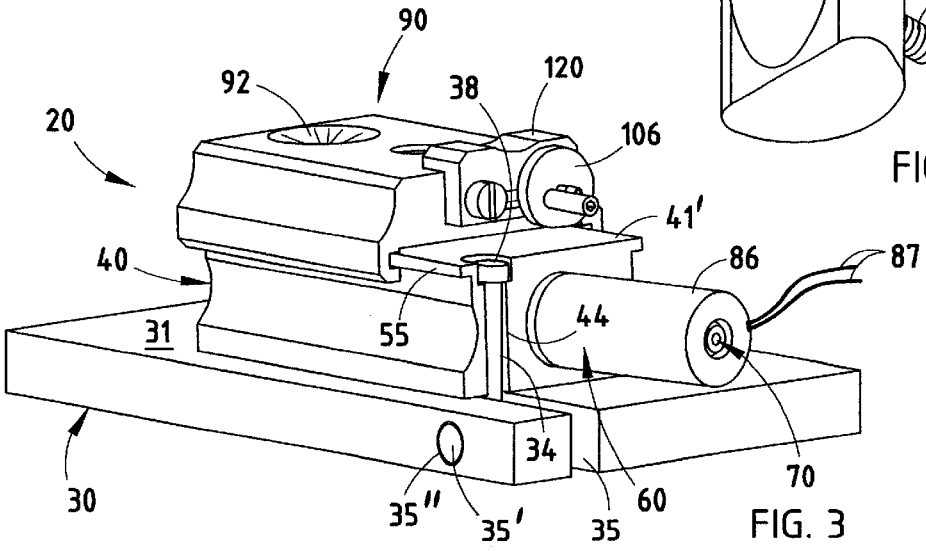
FIG. 3 is an assembled perspective view of the structure shown in FIG. 2.
Figure 2:
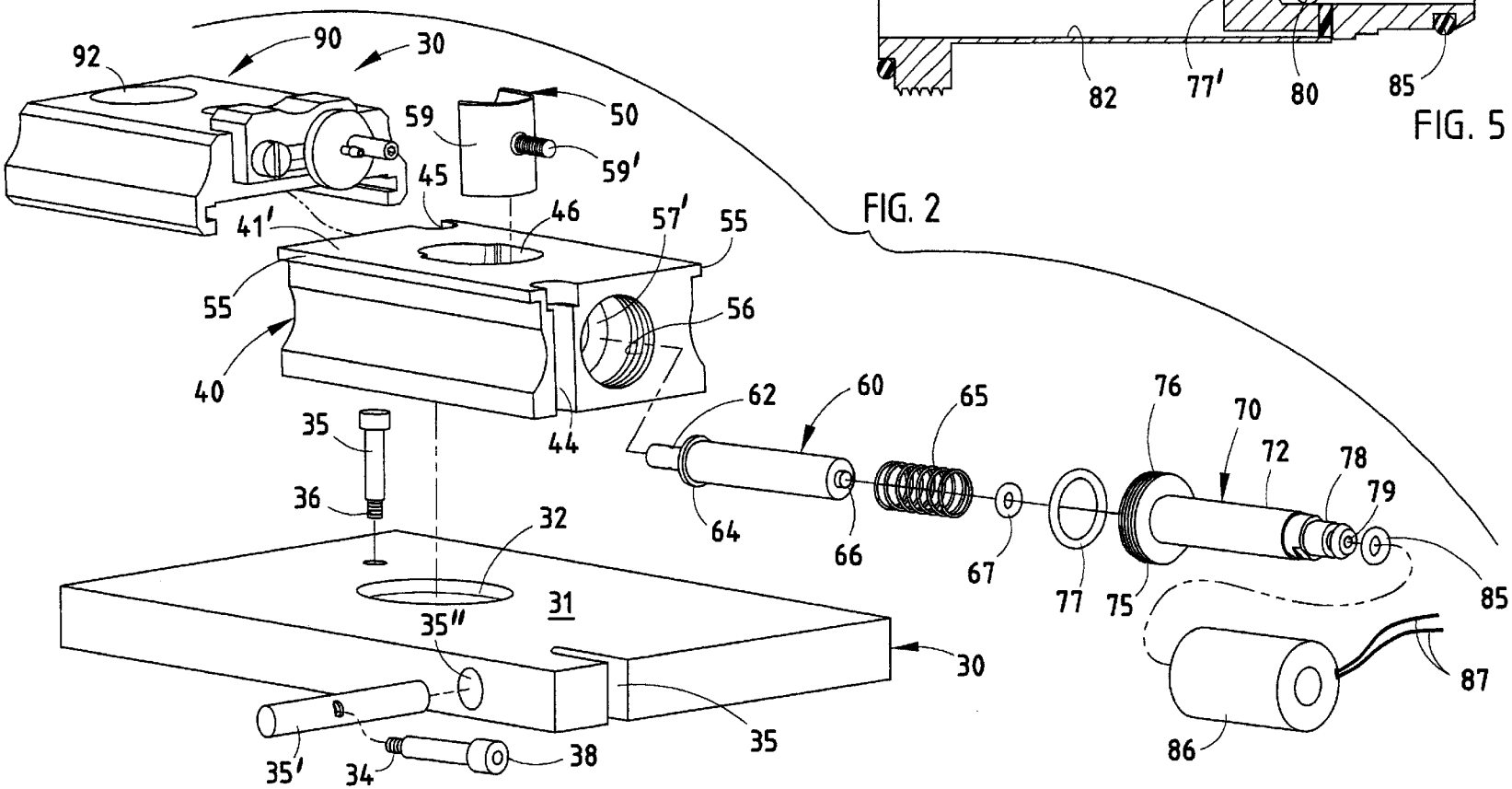
FIG. 2 is an exploded perspective view of a sample drop assembly of the present invention which can be used with the furnace shown in FIG. 1.
Figure 8:
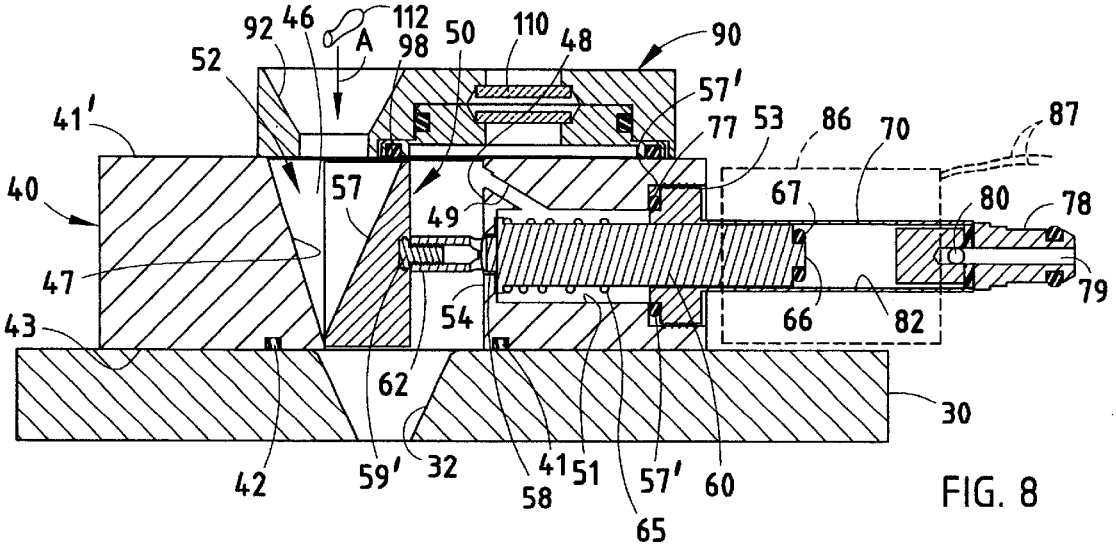
FIG. 8 is a vertical cross-sectional view of the sample drop assembly shown in a first position for loading a sample into the sample drop jaw assembly.
Figure 9:
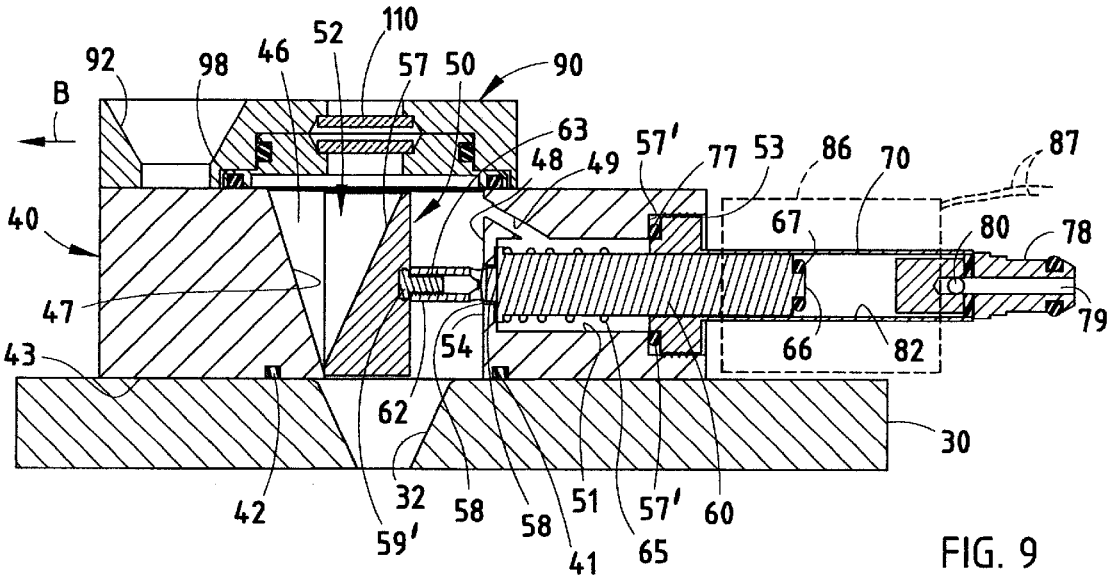
FIG. 9 is a vertical cross-sectional view of the sample drop assembly shown in a second position in which the sample drop jaw assembly is in a sealed position.
Figure 10:
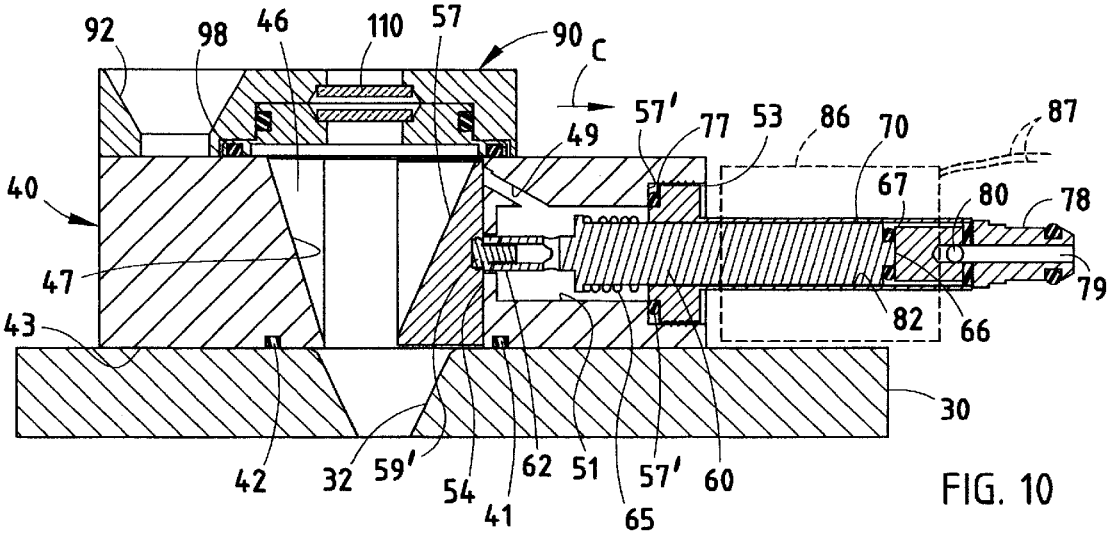
FIG. 10 is a vertical cross-sectional view of the system of the present invention showing the sample drop jaw assembly in a sample drop position for admitting a sample into a crucible of the analytical furnace shown in FIG. 1.

Suitably mounted on top of surface 19 of the furnace 10 shown in FIG. 1 is a sample drop assembly 20 of the present invention, which is shown in FIGS. 2 and 3. The sample drop assembly 20 includes a fixed sample drop block 30, a sample drop jaw assembly 40, and a sample drop slide assembly 90 positioned, as seen in FIG. 3, with block 30 positioned on surface 19 with a conical aperture 32 aligned with the open tapered mouth of conduit 18. Aperture 32, as seen in FIGS. 8–10, is generally conical or funnel shaped, having a relatively wide open mouth narrowing to a size conforming to that of conduit 18. Block 30 is positioned with aperture 32 aligned with conduit 18 such that samples dropped, as described in greater detail below, will fall into the open mouth of crucible 16 during the sample loading operation. Sample drop block 30 includes a pair of toggle bolts 34 and 36 which are pivotally mounted to the undersurface of the sample block and rotate upwardly within slots 35 to allow the sample drop jaw assembly 40 to be removably attached thereon. The sample drop jaw assembly is mounted to the upper surface 31 of block 30, as seen in FIG. 3, with the toggle bolts 34 and 36 including socket heads 38, which seat in configured sockets 44, 45 of assembly 40 when tightened into a threaded aperture in rotatable dowels 35' in apertures 35" to seal and secure the sample drop jaw assembly 40 to the upper surface of block 30. For such purpose, assembly 40 includes an O-ring seal 42 (FIGS. 8–10) which is mounted in an annular recess 41 in the lower surface 43 of jaw assembly 40 to seal the interface between block 30 and drop jaw assembly 40. Blocks 30, 40 and 90 are all machined of suitable nonferrous material, such as aluminum. Both jaw assembly 40 and block 30 are fixedly mounted to the top surface 19 of furnace 10, and slide assembly 90 is slidably mounted to the drop jaw assembly 40 as described below.

Block 40 includes semicylindrical configured sockets 44 and 45 on opposite corners thereof for receiving the toggle bolts 34 and 36, respectively, for securing block 40 to block 30. Block 40 includes, at its upper opposed edges, a pair of outwardly projecting flanges 55 (FIGS. 2 and 3) for captively and slidably receiving the sample drop slide 90 as described below in greater detail. Block 40 includes a central, vertically extending opening 46 (FIGS. 2 and 8–10), which has a side wall 47 tapered to define one side of a sample drop hopper together with a movable jaw 50 (FIG. 6) having a semi-conically tapered side wall 57 mating with side wall 47 and joined together when the jaws are in the closed position as shown in FIGS. 8 and 9 to enclose the lower end of the conical sample dropping chamber 52 so defined. Block 40 includes a semicylindrical surface 48 spaced from and opposed to conical surface 47.

Figure 6:
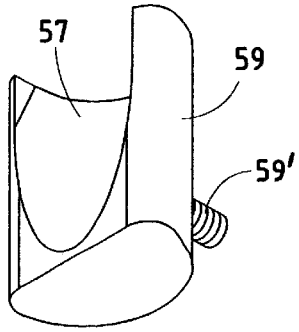
FIG. 6 is an enlarged perspective view of the sample drop jaw employed in the system of the present invention.

Communicating with the chamber 52 defined by the volume between the semi-conical tapered surface 47 and block 50 and the opposed semicylindrical wall 48 is an inclined passageway 49 communicating with an axially extending cylindrical aperture 51 (FIGS. 8–10) terminating in a threaded cylindrical aperture 53 into which a plunger assembly comprising an actuator rod 60 and plunger 70. Aperture 53 is threaded at 56, as best seen in FIG. 2, to receive the threaded end 76 of plunger 70 as shown in the assembled view of FIGS. 8–10. The drop jaw assembly block 40 includes an end wall 54 (FIGS. 8–10) with an aperture 58 therethrough for allowing coupling between the actuator rod 60 and movable jaw 50. Movable jaw 50 is shown in FIG. 6 and is a generally semicylindrical machined aluminum block which slidably moves within the chamber 52 with tapered surface 57 facing mating surface 47 to define an enclosed hopper which can be opened, as seen in FIG. 10, for dropping a sample therefrom into the analytical furnace 10.

The side wall 59 (FIG. 6) of movable jaw 50 includes a threaded stud 59' extending therefrom. The actuator rod 60 includes a cylindrical end 62 having an internally threaded socket 63 that threads onto stud 59' for coupling the actuator plunger rod 60 to the movable jaw 50, as seen in FIGS. 8–10. The end 62 of actuator rod 60 thus extends through aperture 58 in wall 54 of block 50 to communicate with and engage movable jaw 50. Rod 60 is machined of a ferro-magnetic material such as steel, and includes an annular flange 64 (FIGS. 2 and 8–10) near end 62 for receiving a compression spring 65 which, as seen in FIGS. 8 and 9, urges the movable jaw 50 coupled thereto to a closed sample holding position. The rod 60 includes a post 66 at an opposite end for receiving an O-ring 67 which engages an end wall 77' of plunger 70 (FIG. 10) to prevent a metallic interface upon retraction of the rod actuator 60 within plunger 70 as described in greater detail below.

Figure 5:
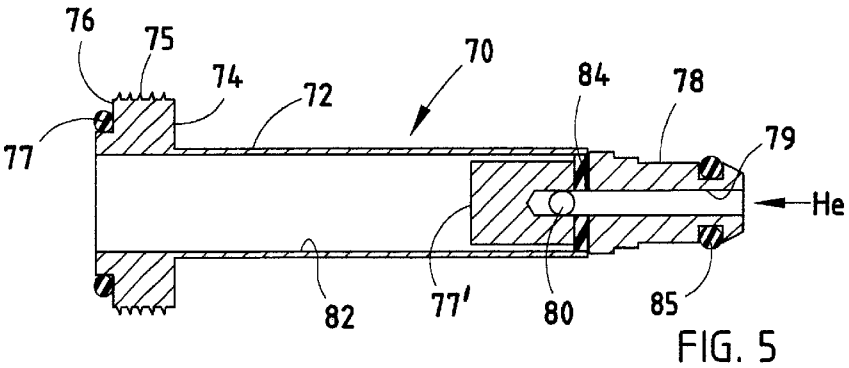
FIG. 5 is an enlarged vertical cross-sectional view of another one of the elements of the assembly shown in FIG. 2.
Figure 4:
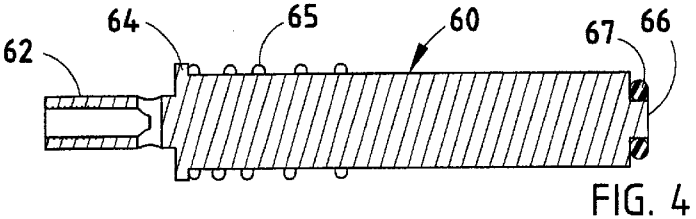
FIG. 4 is an enlarged vertical cross-sectional view of one of the elements of the sample drop assembly shown in FIG. 2.

As best seen in FIG. 5, plunger 70 comprises a thin non-ferrous cylindrical tube 72 which has an annular collar 74 at one end with external threads 75 and an annular shoulder 76 for receiving an O-ring 77 which seats and seals against surface 57' (FIGS. 2 and 8–10) of block 40 for sealing the interface between plunger 70 and block 40.

Plunger 70 further includes a nipple 78 at an end opposite O-ring seal 77 for the admission of an inert gas through an axial opening 79 therein which communicates with a transversely extending aperture 80 to allow an inert gas, such as helium, to flood into the space surrounding the outer diameter of the movable actuator rod 60 and the interior wall 82 of plunger 70. Wall 77' is formed of a cylindrical block dimensioned to allow the helium gas to extend around the periphery thereof and is secured to the nipple 78 by a solder joint 84 (FIG. 5). An O-ring 85 surrounds nipple 78 to allow an airtight coupling of a helium source to nipple 78, which may be threaded to receive a coupling nut or the like for the introduction of the inert gas.

A solenoid actuating coil 86 (FIGS. 2, 3, and 8–10) surrounds the outer cylindrical surface 72 of plunger 70 and includes a pair of conductors 87 coupled to a suitable electrical control circuit for inducing a magnetic field within plunger 70, drawing the ferro-magnetic actuator rod 60 into the plunger cylinder to a position shown in FIG. 10 when actuated for sliding jaw 50 to the open position as shown in FIG. 10. The jaw can move relatively freely within the chamber 52 defined within block 40 and yet is completely sealed by the utilization of the O-ring seal 77 from the outside atmosphere. Thus, there are no dynamic seals associated with the movable jaw assembly as it moves from a closed to an open position. Instead, the jaw is freely movable under the influence of a magnetic field which couples the plunger to the actuating solenoid 86.

A sample is admitted to the sample drop jaw assembly 40 through the sample drop slide assembly 90 now briefly described in conjunction with FIGS. 7–10. Sample drop slide 90 is a machined aluminum block which includes a conically tapered aperture 92 which aligns with the chamber 52 when in the sample drop position shown in FIG. 8. Adjacent aperture 92 is a sealing piston assembly comprising a disk-shaped piston 94 having a piston seal 95 mounted to the outer cylindrical periphery thereof and an annular groove 96 on its face facing the upper surface 41' of block 40 for receiving an O-ring seal 98. Seal 98 effectively seals the open mouth 46 of the sample drop jaw assembly when in a position shown in FIG. 9 and described below. The piston 94 and its seal 95 is received in a piston cylinder 100 formed in block 90 which includes a pair of inwardly facing slots 102 which slidably fit over and captively hold sample drop slide 90 to block 40 by engaging flanges 55. A source of pressurized air communicates with cylinder 100 through aperture 104 and a sealed coupling 106 coupled to threaded aperture 104 by an O-ring seal 105 to pressurize the piston 94, pushing it downwardly against the sealing surface 41' of block 40 during dropping of a sample and subsequent combustion of the sample by furnace 10. The sliding block 90 may include a sealed window 108 allowing an operator to view downwardly into the analytical furnace during a cycle of combustion. For such purpose, a quartz window 110 (FIGS. 8–10) suitably sealed to block 40 can be employed for providing viewing of the combustion operation. An actuator arm 120 is coupled to slide 90 on a pneumatic actuator (not shown) for moving slide 90 between sample loading and sample dropping positions during operation of the sample loading assembly 20 as now described in connection with FIGS. 8–10.

Sample loading is accomplished by positioning sample drop slide 90 with open mouth 92 above the chamber 52 of sample drop jaw assembly 40 as seen in FIG. 8. In this position, a sample, such as a pin, chip, or rod sample 112, can be dropped by an operator downwardly in the direction indicated by arrow A through the funnel-shaped opening 92 into the hopper defined by fixed side wall 47 of block 40 and the movable side wall 57 of movable jaw 50. The sample is retained in the bottom of the hopper so defined and slide 90 is then moved in a direction indicated by arrow B, as shown in FIG. 9, such that the piston sealing O-ring 98 surrounds the upper circular opening of hopper 52 and pressure is applied to the piston through fitting 106 to pressurize the piston, thereby forming a sealing engagement with drop jaw assembly 40.

At this time, an inert gas, such as helium, is introduced through fitting 78 with the flow of gas entering opening 79, extending through transverse opening 80 into the annular space between the outer surface of actuator rod 60 and the inner surface 82 of cylinder 72 through upwardly extending passageway 49 into the volume of hopper 52 including the area surrounding cylindrical wall 48. The gas advances downwardly through the jaws into channel 18 of the now enclosed electrodes of the furnace, outwardly through tube 13 and into the analyzer. After a suitable purge time, solenoid 86 is actuated by a control signal on conductors 87 to retract jaw 50 to the right, as indicated by arrow C in FIG. 10, allowing the sample 112 to drop by gravity through the funnel-shaped opening 32 aligned with conduit 18 in upper electrode assembly 12. It is noted that by elimination of separate jaw members and by machining surface 47 into block 40, the amount of trapped air space needing to be purged is greatly reduced, allowing the purging time to be less. The helium gas continues to flow through the opening 79 and passageway 49 into the area provided by the loosely fitted movable jaw 50 downwardly, as indicated by arrow D in FIG. 10, to continuously sweep byproducts of combustion out of the furnace 10 through conduit 13 into an analyzer (not shown) during a cycle of analysis.

Actuator arm 120 can be coupled to a suitable pneumatic cylinder with a throw length sufficient for moving slide 90 between the sample admission position shown in FIG. 8 to a sealing position shown in FIGS. 9 and 10. It is noted also that the slide 90 may be moved from left to right as opposed to right to left, such that a sample can be admitted to opening 92 and rest on the upper surface 41' of block 40 until such time as it is desired to be dropped into the hopper 52 by moving the slide to the position shown in FIG. 8 from a position to the left of that shown in FIG. 8. Subsequently, the slide will be moved again to a position as shown in FIG. 9 for the operation of the piston seal enclosing the hopper 52.

It is seen, therefore, with the sample drop assembly 20 of the present invention, a sample can be admitted to a sample drop jaw assembly which is subsequently sealed from the atmosphere and the jaw can be moved without the use of dynamic seals on the moving parts of the jaw, thereby preventing any minute amount of contaminant gas which may otherwise be present in a dynamic seal construction from entering the combustion zone during an analysis. The result is that very small levels of oxygen and nitrogen can be detected by an analyzer without interference from atmospheric oxygen and nitrogen which otherwise may leak into the system through sample assemblies. By providing a single movable jaw element also, the volume which must be purged using an inert gas is reduced, and, by providing a spring loaded jaw assembly which holds a sample in a closed sample holding position, only momentary actuation of the solenoid 86 is required to drop a sample into the furnace for analysis. The jaw 50 can be retracted as desired, however, for viewing the sample through the quartz window 110 during an analysis, if desired.

It will become apparent to those skilled in the art that various modifications to the preferred embodiment of the invention as described herein can be made without departing from the spirit or scope of the invention as defined by the appended claims.

The invention claimed is:

1. A sample dropping assembly for introducing an analytical sample into an analytical furnace comprising:

a sample drop jaw assembly having a sealed sample dropping chamber and at least one movable element positioned in said chamber, wherein said movable element is movable between a sample holding position and a sample dropping position, wherein the improvement comprises a magnetic actuator coupled to said movable element for moving said movable element between said sample holding position and said sample dropping position.

2. The assembly as defined in claim 1 wherein said assembly includes a block including a conically tapered wall and a semi cylindrical wall spaced from said conically tapered wall to define said sample dropping chamber and wherein said movable element is movably positioned in said chamber adjacent said conically tapered wall.

3. The assembly as defined in claim 2 wherein said movable element comprises a sample dropping jaw having a conically tapered surface facing said conically tapered wall of said block.

4. The assembly as defined in claim 3 wherein said actuator includes an actuator rod extending into said block and coupled to said jaw for moving said jaw between a sample holding position and a sample dropping position.

5. The assembly as defined in claim 4 wherein said actuator further includes a plunger for movably receiving said actuator rod therein, said plunger sealably coupled to said block to prevent admission of ambient atmospheric gasses into said chamber.

6. The assembly as defined in claim 5 wherein said plunger is generally cylindrical and includes one end which is open to receive said actuator rod therein and an opposite end having a fitting for the admission of an inert gas therein.

7. The assembly as defined in claim 6 wherein said actuator rod is made of a ferro-magnetic material and further including a solenoid coil mounted to surround said plunger for moving said actuator rod into said plunger when an electrical current flows through said coil to move said sample dropping jaw to a sample releasing position.

8. The assembly as defined in claim 7 and further including a compression spring positioned between said actuator rod and said plunger for urging said sample dropping jaw to a sample holding position.

9. The assembly as defined in claim 8 wherein said block includes a passageway coupling said chamber with said plunger for admitting an inert gas from said fitting of said plunger into said chamber.

10. The assembly as defined in claim 9 wherein said fitting includes an axially extending opening and a radially extending opening communicating with said axially extending opening for admitting an inert gas into said plunger.

11. The assembly as defined in claim 10 and further including a sample slide assembly movably positioned on said block for admitting a sample into said sample dropping chamber and subsequently sealing said chamber.

12. The assembly as defined in claim 1 and further including a sample slide assembly movably positioned on said sample dropping assembly for admitting a sample into said sample dropping chamber and subsequently sealing said chamber.

13. A sample dropping assembly for introducing an analytical sample into a crucible of an analytical furnace comprising:

a sample dropping block for mounting to an analytical furnace, said block having a chamber with a vertically extending opening for receiving a sample from the top and dropping a sample into a crucible of the furnace from the lower end of the opening, said chamber including a movable jaw assembly for selectively holding a sample in the chamber until the chamber is purged of contaminates, said movable jaw assembly comprising at least one movable element and a magnetic actuator for controlling the movement of said movable element between a sample holding position and a sample dropping position.

14. The assembly as defined in claim 13 wherein said block includes a conically tapered wall and a semi cylindrical wall spaced from said conically tapered wall to define said chamber.

15. The assembly as defined in claim 14 wherein said movable element is movably positioned in said chamber adjacent said conically tapered wall.

16. The assembly as defined in claim 15 wherein said movable jaw comprises a sample dropping jaw having a conically tapered surface facing said conically tapered wall of said block.

17. The assembly as defined in claim 16 wherein said magnetic actuator includes an actuator rod extending into said block and coupled to said jaw for moving said jaw between a sample holding position and a sample dropping position.

18. The assembly as defined in claim 17 wherein said actuator further includes a plunger for movably receiving said actuator rod therein, said plunger sealably coupled to said block to prevent admission of ambient atmospheric gasses into said chamber.

19. The assembly as defined in claim 18 wherein said plunger is generally cylindrical and includes one end which is open to receive said actuator rod therein and an opposite end having a fitting for the admission of an inert gas therein.

20. The assembly as defined in claim 19 wherein said actuator rod is made of a ferro-magnetic material and further including a solenoid coil mounted to surround said plunger for moving said actuator rod into said plunger when an electrical current flows through said coil to move said sample dropping jaw to a sample releasing position.

21. The assembly as defined in claim 20 and further including a compression spring positioned between said actuator rod and said plunger for urging said sample dropping jaw to a sample holding position.

22. The assembly as defined in claim 21 wherein said block includes a passageway coupling said chamber with said plunger for admitting an inert gas from said fitting of said plunger into said chamber.

23. The assembly as defined in claim 22 wherein said fitting includes an axially extending opening and a radially extending opening communicating with said axially extending opening for admitting an inert gas into said plunger.

24. The assembly as defined in claim 23 and further including a sample slide assembly movably positioned on said block for admitting a sample into said sample dropping chamber and subsequently sealing said chamber.

25. An analytical furnace comprising:

a lower electrode for supporting a graphite crucible thereon;

a upper electrode for engaging an upper edge of said graphite crucible, said upper electrode including a conduit for the admission of a sample to be analyzed into said crucible; and a sample dropping block for mounting to said upper electrode, said block having a chamber with a vertically extending opening for receiving a sample from the top and dropping a sample into said conduit of said upper electrode and into a crucible of the furnace from the lower end of the opening, said chamber including a movable jaw assembly for selectively holding a sample in the chamber until the chamber is purged of contaminates, said movable jaw assembly comprising at least one movable element and a magnetic actuator for controlling the movement of said movable element between a sample holding position and a sample dropping position.

26. The furnace as defined in claim 25 wherein said chamber includes a conically tapered wall and a semi cylindrical wall spaced from said conically tapered wall to define said chamber.

27. The furnace as defined in claim 26 wherein said movable element is movably positioned in said chamber adjacent said conically tapered wall.

28. The furnace as defined in claim 27 wherein said movable jaw comprises a sample dropping jaw having a conically tapered surface facing said conically tapered wall of said block.

29. The furnace as defined in claim 28 wherein said magnetic actuator includes an actuator rod extending into said block and coupled to said jaw for moving said jaw between a sample holding position and a sample dropping position.

30. The furnace as defined in claim 29 wherein said actuator further includes a plunger for movably receiving said actuator rod therein, said plunger sealably coupled to said block to prevent admission of ambient atmospheric gasses into said chamber.

31. The furnace as defined in claim 29 wherein said plunger is generally cylindrical and includes one end which is open to receive said actuator rod therein and an opposite end having a fitting for the admission of an inert gas therein.

32. The furnace as defined in claim 31 wherein said actuator rod is made of a ferro-magnetic material and further including a solenoid coil mounted to surround said plunger for moving said actuator rod into said plunger when an electrical current flows through said coil to move said sample dropping jaw to a sample releasing position.

33. The furnace as defined in claim 32 and further including a compression spring positioned between said actuator rod and said plunger for urging said sample dropping jaw to a sample holding position.

34. The furnace as defined in claim 33 wherein said block includes a passageway coupling said chamber with said plunger for admitting an inert gas from said fitting of said plunger into said chamber.

35. The furnace as defined in claim 34 wherein said fitting includes an axially extending opening and a radially extending opening communicating with said axially extending opening for admitting an inert gas into said plunger.

36. The furnace as defined in claim 35 and further including a sample slide assembly movably positioned on said block for admitting a sample into said sample dropping chamber and subsequently sealing said chamber.

* * * * *